US010118287B2

(12) United States Patent
Billups, Jr.

(10) Patent No.: US 10,118,287 B2
(45) Date of Patent: Nov. 6, 2018

(54) PUSH BUTTON RELEASE MULTIPLE SOCKET HOLDER

(71) Applicant: William Lawrence Billups, Jr., Glen Allen, VA (US)

(72) Inventor: William Lawrence Billups, Jr., Glen Allen, VA (US)

( * ) Notice: Subject to any disclaimer, the term of this patent is extended or adjusted under 35 U.S.C. 154(b) by 0 days.

(21) Appl. No.: 15/046,754

(22) Filed: Feb. 18, 2016

(65) Prior Publication Data

US 2016/0243695 A1 Aug. 25, 2016

Related U.S. Application Data

(60) Provisional application No. 62/176,412, filed on Feb. 19, 2015.

(51) Int. Cl.
*B25H 3/00* (2006.01)

(52) U.S. Cl.
CPC ..... *B25H 3/003* (2013.01)

(58) Field of Classification Search
CPC ..... A47F 5/0846; A47F 7/0028; B25B 13/06; B25B 13/56; B25H 3/00; B25H 3/003; B25H 3/04; B25H 3/06
USPC ..... 211/69, 69.5, 69.6, 70.6; 206/372, 378
See application file for complete search history.

(56) References Cited

U.S. PATENT DOCUMENTS 5,228,570 A * 7/1993 Robinson ..... B25H 3/06 206/375
5,398,823 A * 3/1995 Anders ..... B25H 3/003 206/378
5,467,874 A * 11/1995 Whitaker ..... B25H 3/06 206/378
5,715,951 A * 2/1998 Dembicks ..... B25H 3/06 206/378
6,386,363 B1 * 5/2002 Huang ..... B25H 3/003 206/1.5
6,431,373 B1 * 8/2002 Blick ..... B25H 3/003 206/378
6,991,105 B2 * 1/2006 Winnard ..... B25H 3/003 206/378
7,152,747 B2 * 12/2006 Wang ..... A47F 7/024 211/70.6
8,556,075 B1 * 10/2013 Ou ..... B65D 73/0064 206/372
2005/0221664 A1 * 10/2005 Winnard ..... B25H 3/003 439/510
2010/0065520 A1 * 3/2010 Hsieh ..... B25H 3/06 211/70.6
2011/0089126 A1 * 4/2011 Hsieh ..... B25H 3/003 211/70.6
2012/0061339 A1 * 3/2012 Chang ..... A47F 5/0006 211/70.6

(Continued)

*Primary Examiner* — Joshua E Rodden

(57) ABSTRACT

A socket holder with a built in locking mechanism that is user controlled and activated by a push button which controls internal locking mechanisms which allow this socket holder to securely store and transport sockets mounted to it. This socket holder can hold multiples of the sockets to its main socket holder body, releasing them only when desired by the user with the push of the push button that controls the internal mechanisms which release the sockets from the socket holder body. This socket holder is designed to organize and securely lock the sockets onto its socket holder body in a way that is dependable and easy to use.

13 Claims, 12 Drawing Sheets

(56) References Cited

U.S. PATENT DOCUMENTS

2014/0260826 A1* 9/2014 Eggert ..... B25B 23/0035
81/124.6
2016/0096264 A1* 4/2016 Kao ..... B25H 3/06
206/378

* cited by examiner

PUSH BUTTON RELEASE MULTIPLE SOCKET HOLDER

BACKGROUND OF THE INVENTION

The field of endeavor which is being discussed here relates to tools and equipment that use mechanical fasteners such as bolts, nuts, screws and in particular to the kind of tools that have "sockets" such as mechanics sockets in automobile repairs, aircraft and machinery. Even more particular to the actual "holders of these sockets." The "socket holder" being very important as these various sized sockets in different sized sets come in a multiple of different sizes for various kinds of fasteners and in a multiple of different connecting drive size's that tools using these said sockets use make making the need for a durable and reliable holder with this new Locking Mechanism of Locking sockets onto their holder a feature and a necessity that has not been previously there and the lack of it not being there the cause of much frustration, confusion and time wasting in the past looking for these many different sockets while working on various jobs using sockets in the past.

With many different size sockets and different drive sizes not being kept in decent order with a secure and reliable way of doing this has been the reason for much confusion and wasted time. (example) ¼" ⅜" ½" ¾" 1" and above drive sizes for various tools, and each size drive of a socket has many working size ends that go on each set. This is why it is very important to have a secure and durable way that is easy to use and reliable.

The background of the invention comes from the need of: NOT having a strong and reliable way to easily lock mount and dismount tool sockets to a socket holder in a strong, secure reliable and easy to use dependable way.

The previous way of carrying these tool sockets for many people was to just put them in a box or a bag, making these sockets very hard to access easily and quickly, and causing great frustration for many when looking for said sockets when they were needed on any particular job where a multiple of different size sockets were needed.

Also there have been a few unreliable and not very dependable devices that have been used that did not have a locking mechanism on them to keep these various sockets in their respective storage spaces when not being used for work or in transport while also not being very durable. For the most part it seemed the only time a set of sockets was in order and easy to find was when they first came in the box or in the shipping container from the manufacturer of these said sockets, and because previous socket holders could not Lock on Sockets to a multiple socket holder device in a secure and durable way use and transport of these socket holders was not practical for mobile use in and around the shop and to and from various job locations.

The invention being introduced here in this application, gives a strong reliable and effective way of Locking sockets onto a socket holder while organizing, storing and transporting these kinds of tool sockets to users of said sockets that has previously not been available to them, the user of such tool sockets to use to hold their tool sockets while doing various jobs with them and then transporting them to their next job site.

Using this Secure and Lockable socket holder device will maintain these sockets in their organized holding spaces on the socket holder dependably.

Keeping these sockets of different varying sizes in their respective holder spaces securely and dependably according to their ascending or descending size order will enable quick and easy access to them when they are needed for use, eliminating wasted time and frustration looking for them by keeping them stored in an orderly fashion on the easy to use, lockable "PUSH BUTTON RELEASE MULTIPLE SOCKET HOLDER" being introduced here.

BRIEF SUMMARY OF THE INVENTION

The invention claimed here is a "PUSH BUTTON RELEASE MULTIPLE SOCKET HOLDER" which is designed to securely hold a multiple amount of various sized tool sockets to a socket holder with a user controlled locking mechanism.

The main feature of the socket holder being introduced here is its ability to hold sockets onto its main socket holder body with a user controlled Lockable internal mechanism.

This locking on and off of a multiple amount of various sized sockets to its main socket holder body, while keeping them in an organized way dependably, while also providing a quick and easy way of doing locking on and off of sockets with the push of a button is the reason for the introduction of this the herein named invention of a "PUSH BUTTON MULTIPLE SOCKET HOLDER".

With the simple push of this heretofore mentioned socket holders Main Push Button, multiples of sockets can be placed on or off of its main holder body quickly and easily as needed.

Sockets are to be released from this socket holders storage body only when the locking mechanism is engaged by the push of the PUSH BUTTON on the socket holder body by the user.

The locking mechanism that securely holds the sockets in their designated storage locations on this "PUSH BUTTON RELEASE MULTIPLE SOCKET HOLDER" is performed by a series of internal locking mechanisms which are controlled by the push of a PUSH BUTTON and solves the previously existing problems of loose and scattered sockets as identified and mentioned in the background of the invention.

Being strong in design and with its locking mechanism holding the mounted sockets onto its socket holder body in their designated drive and socket size storage spaces on the socket holder while also allowing for fast and easy mounting and retrieval of the many sockets being stored it by its locking PUSH BUTTON hold and release feature the "PUSH BUTTON RELEASE MULTIPLE SOCKET HOLDER" will be organized and ready for work when it is needed by the user of these tool sockets.

Being able to carry a multiple of various sized sockets that are mounted in a very organized and orderly fashion will allow for convenient and easy use at any job location where this the "PUSH BUTTON RELEASE MULTIPLE SOCKET HOLDER" is at with its complete and organized set of locked onto it, sockets will be in order and ready to be put to work with all of the sockets being held in their organized and locked on way to the main socket holders storage space order waiting to be used and put to work on this the "PUSH BUTTON RELEASE MULTIPLE SOCKET HOLDER".

PARTS LIST

Figure 1:
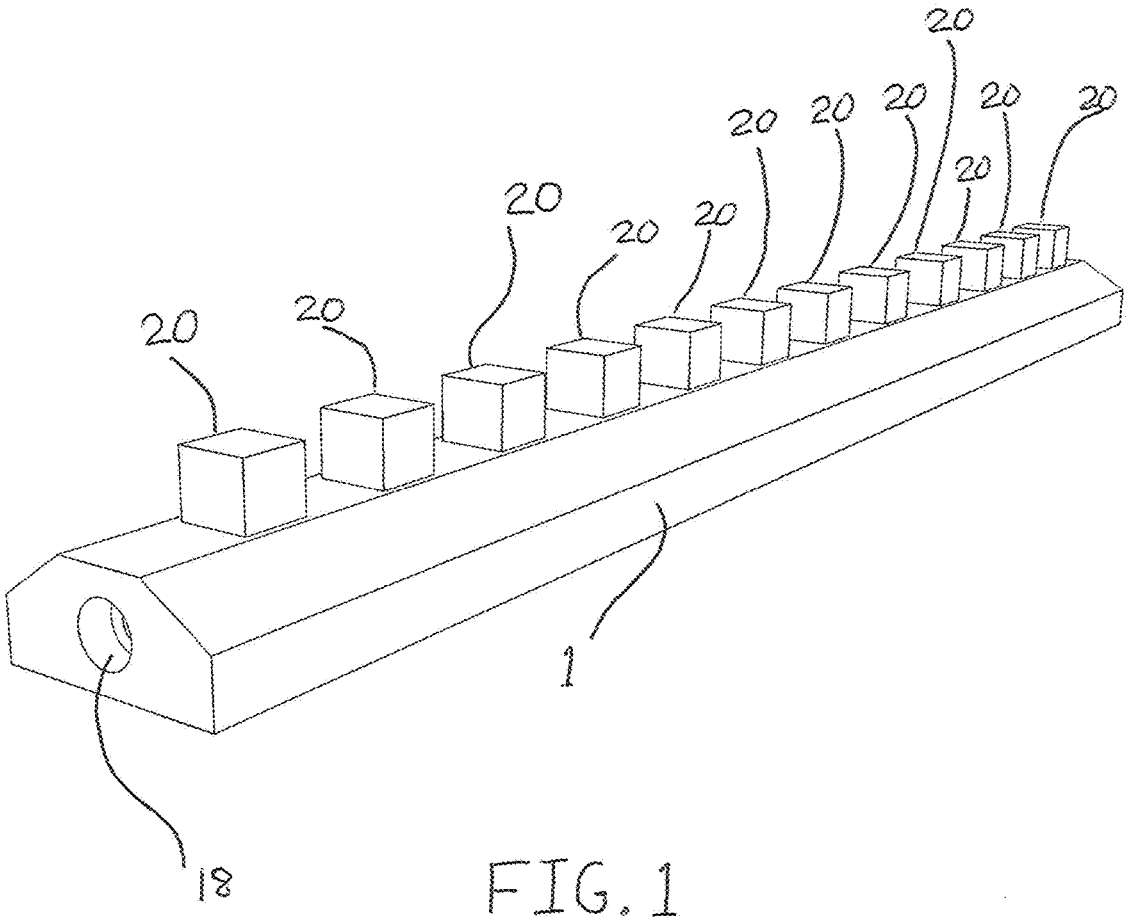
FIG. 1 Is an isometric view of the push button release multiple socket holder which has an internal socket holding locking control mechanism, which uses a push button to control the hold and release of sockets being held to its main socket holder body. Internal mechanisms control the movement action of socket holding locking balls.

1. MAIN SOCKET HOLDER BODY
2. MAIN PUSH ROD SLOT
3. PUSH BUTTON
4. MAIN RELEASE CONTROL ROD
5. MAIN SPRING
6. MAIN SPRING HOLDER POSITION
7. SOCKET LOCKING BALLS
8. SOCKET LOCKING BALL HOLES
9. INTERNAL LOCKING BALLS
10. PUSH RODS
11. INDIVIDUAL SOCKET HOLDER PUSH SPRINGS
12. BACKING PLATE
13. CONTROL ROD LOCK KEY
14. CONTROL ROD LOCK NOTCH
15. MAIN BODY CONTROL ROD LOCK KEY NOTCH
16. GUIDE HOLES FOR PUSH RODS
18. RECESSED PUSH BUTTON OPENING
19. HANDLE
20. INDIVIDUAL SOCKET HOLDER MOUNTINGS
22. STAMPED SIZES OF SOCKET HOLDER SPACES SAE AND METRIC OR AS DESIRED
23. MODIFIED PUSH ROD
24. MAIN RELEASE CONTROL ROD INTERSECT NOTCHES
31. ANGLED SURFACES
32 BUBBLE LEVEL
33. MAGNETIC TOOL PICKUP

DETAILED DESCRIPTION OF THE INVENTION

The invention being discussed here is a tool socket holder which has a built in user controlled internal locking mechanism. This locking mechanism allows users of this multiple socket holder to place sockets securely onto the socket holder where they are to be held until they are released by the internal locking mechanism's by the pressing of this socket holders push button release control mechanism.

This locking multiple socket holder has been given a name and it is herein called a "PUSH BUTTON RELEASE MULTIPLE SOCKET HOLDER" and by means of built in mechanical locking control mechanism's it performs the task of holding and releasing sockets from its main body. The internal locking mechanism's are controlled by the pressing down of a push button which protrudes out of its main body into a recessed opening. The exposed push button which goes into the recessed opening on the main socket holders body also goes down through the socket holders main body where it intersects other internal parts where it creates the holding and releasing action for the sockets to be mounted onto the socket holders main body.

This device is designed to hold or release sockets held onto its main body quickly and easily and securely only to be released when desired by the user through use of its push button.

The kind of sockets being discussed here are of the kind and type that are commonly used by mechanics and construction workers on their ratchet wrench's, breaker bars, impact wrench guns etc, or any type of fastener driver head that is mounted onto a socket and is to become part of a socket driven system.

The "PUSH BUTTON RELEASE MULTIPLE SOCKET HOLDER" has a main body, a multiple of individual socket holder spaces on it, with each socket holder space on the main socket holder body having its own built in individual secure socket holding locking ball release mechanism.

These built in secure socket holding locking ball release mechanisms are all in the socket holding lock positions when the main push button is not being pushed down. To release sockets from the locking ball mechanism's of the socket holder the user has to press down on the push button. When the user is ready to lock the sockets back onto the socket holder all they have to do is let go of the push button, because internal spring mechanism's lift the push button and push all moving parts back to the position of locking sockets on mode.

As many individual socket holder spaces as desired can be built into the main socket holders main body, along with having different size drive socket spaces, all using the basic design shown here in this disclosure.

On the back side of the socket holders main body there is an opening called the main body lock notch which holds a special lock key in its place, this lock key serves the purpose of allowing the push button main release control rod to go up and down in the main body of the socket holder intersecting with the internal parts that control the locking mechanism's while also keeping the push button from coming out of the socket holders main body when not being pushed down by the user. This key intersects with a cutout space on the main release control rod which goes up and down in the main body in the main push rod slot. At the end of this main release control rod is the push button of the socket holder which protrudes into a recessed opening of the socket holder.

The back plate is mounted on the back of the main body of the socket holder into its designated cut out space. This back plate can have a magnetic back on it if desired and serves the purpose of keeping dirt and debris out of the socket holders main body internal parts section. After all the internal parts are installed and the back plate is mounted the only external moving parts on the "PUSH BUTTON RELEASE MULTIPLE SOCKET HOLDER" are the push button in the recessed opening, and the locking balls on each of the designated socket holding places on the main socket holder.

Other features that can be made into the "PUSH BUTTON RELEASE MULTIPLE SOCKET HOLDER" that an not shown in the drawings but are being described here are as listed below.

Figure 2:
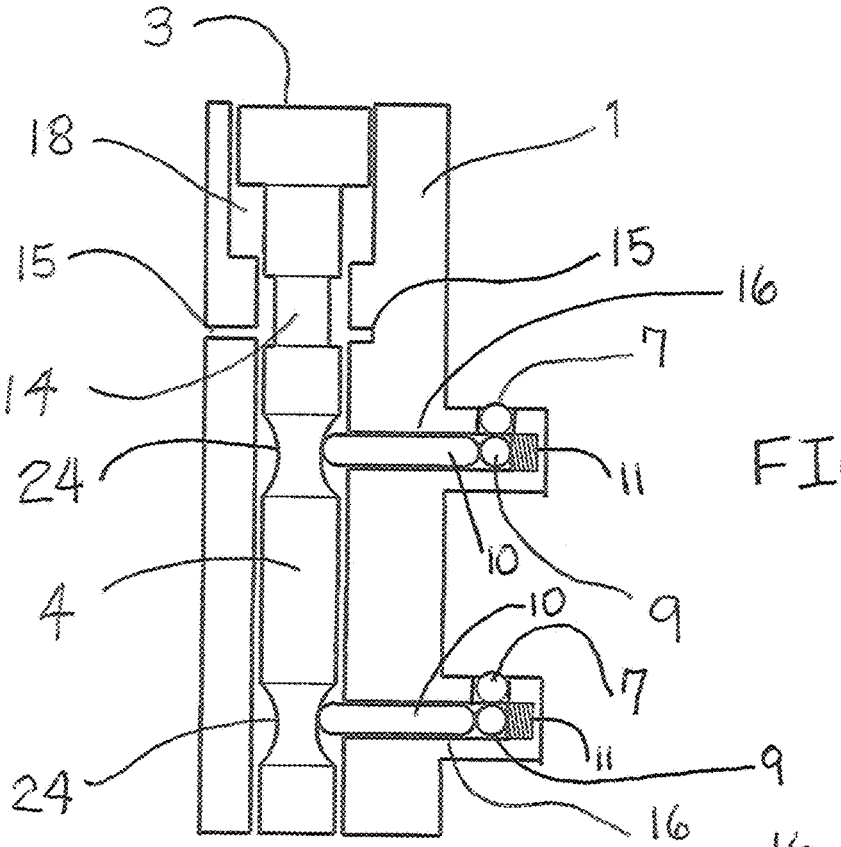
FIG. 2 Is a parallel projection cross sectional view of the working upper end of the push button release multiple socket holders internal mechanisms and how they intersect with each other.
Figure 3:
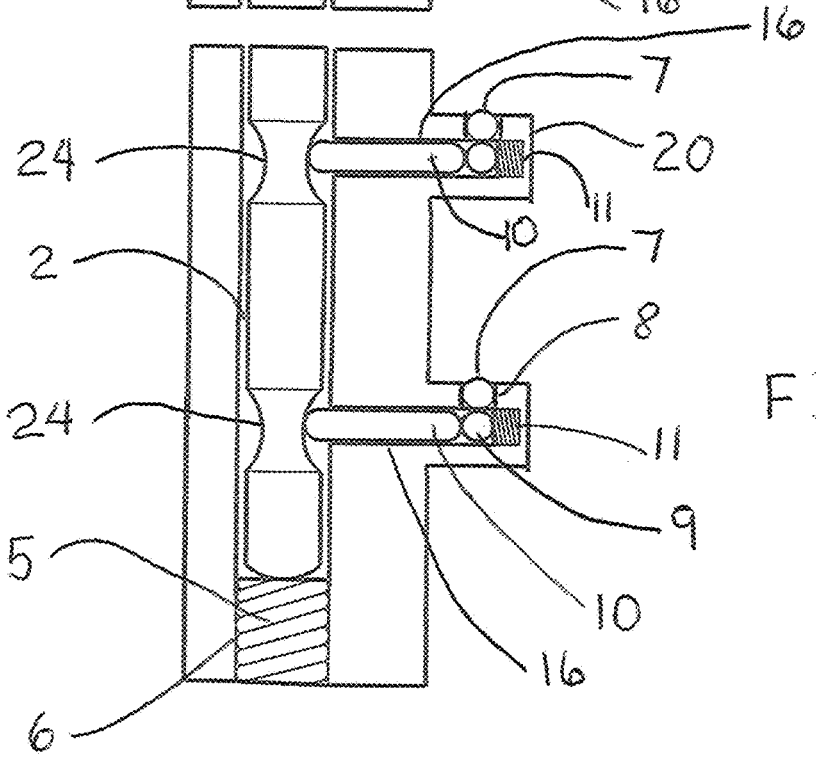
FIG. 3 Is a parallel projection cross sectional view of the internal mechanisms and how they intersect with each other.
Figure 4:
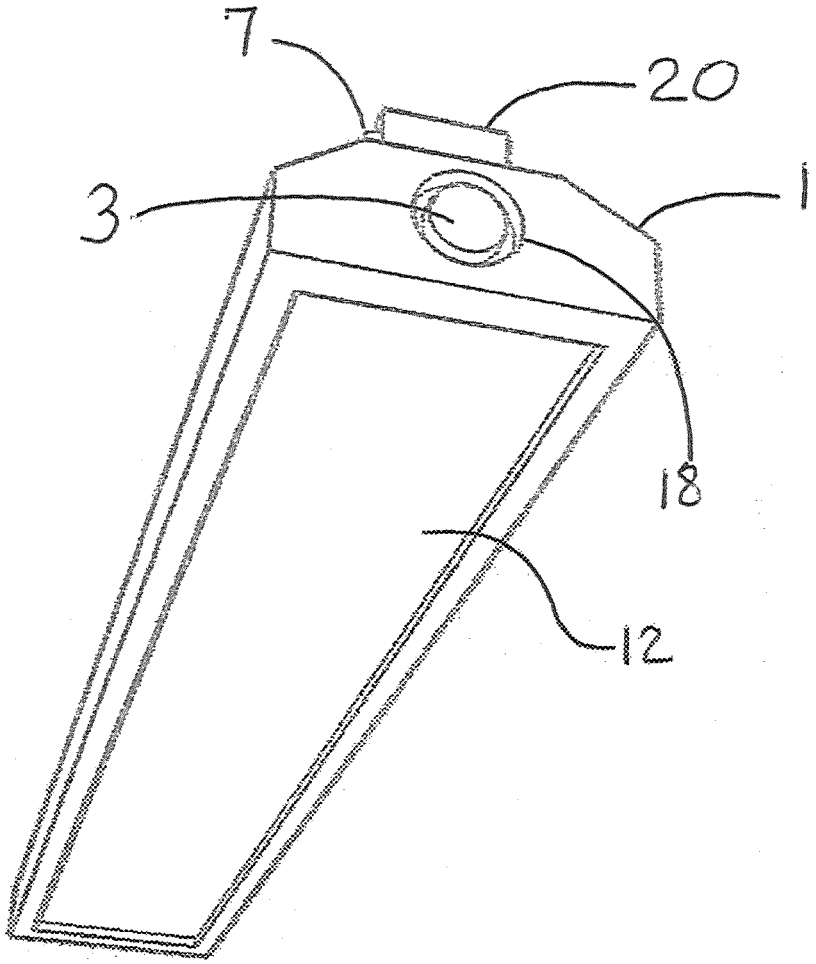
FIG. 4 Is an isometric view of the push button release multiple socket holders bottom backing plate, the recessed opening in the body of the socket holders top, where the main release control rods top section which is the push button is to be activated from in the socket holders main body.
Figure 5:
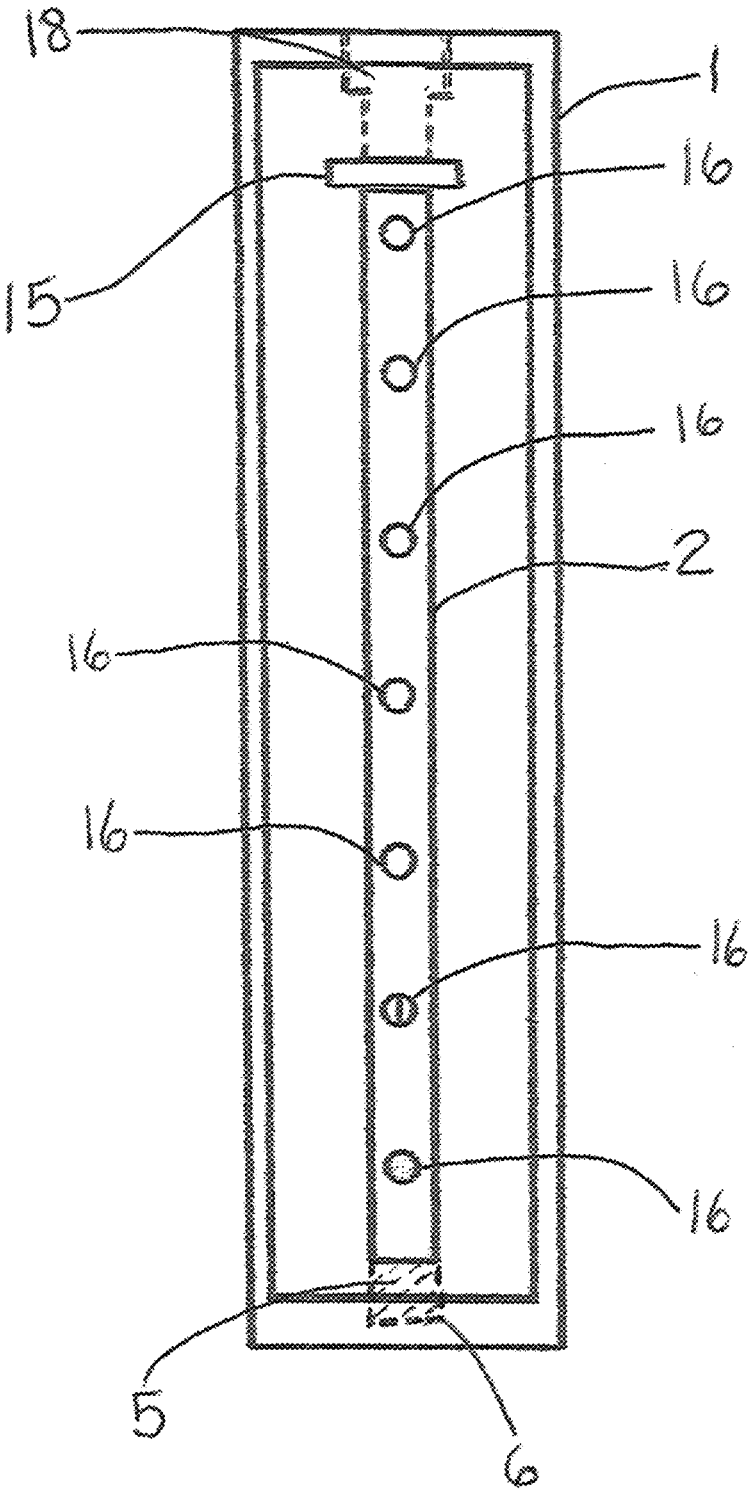
FIG. 5 Is a parallel projection of the back side of the push button release multiple socket holders body without the backing plate on it, showing main push rod slot, main body control rod lock key notch, guide holes for push rods, and recessed push button opening.

1. as an alternative embodiment to internal locking balls 9 as shown in FIG. 2. and FIG. 3. the internal locking balls 9 could be replaced by a push rod 10 that has been modified by being a little longer and having a small rounded notch resembling main release control rod intersect notches 24 the placement of a small notch in it that would allow the socket locking ball 7 to go down in the socket locking ball holes 8 when push button 3 is pressed down allowing for the sockets locking balls 7 holding and release mechanisms to operate and function as described with the preferred embodiment shown in the drawings from the individual socket holder mountings 20 socket locking ball holes 8 which would allow for in and out movement of the socket locking balls 7 this alternative modification could be used to replace the internal locking ball 9 and leave a push rod 10 that is a little longer with a slight notch in it resembling the main release control rod intersect notches of 24 but only in a smaller size so the push rods 10 would go into guide holes for push rods 16.
2. also as shown in FIG. 4 area of the drawings a small sliding cover plate could be mounted onto the top of the socket holders main body 1 push button 3 and recessed push button opening 18 hole, this would add to preventing accidental pushes of the release push button 3 and also help to keep this recessed push button opening 18 hole clean from foreign matter and debris.
3. also as shown in FIG. 4 area of the drawings on main socket holder body 1 at both sides of push button 3 and recessed push button opening 18 could be handle mounting holes which have an internal notch allowing for a push button plug device to go into them and have a handle attached to it, it would resemble the push button type of connector that is on a locking key holder. With a push of each handles button connector each side of the handle could go down into a hole mounted on each side of the recessed push button opening 18. Also these connector holes in the main socket holder body could be connected together for carrying multiple main socket holder body's 1 as desired. The use of push button connection with an internal ball and connection hole with an internal connection ring notch would allow for the handles to be removed if not needed or desired.
4. also in FIG. 4 area of the drawings on the main socket holder body 1 where the backing plate 12 is could be a magnet mounted if desired for holding the "PUSH BUTTON RELEASE MULTIPLE SOCKET HOLDER" to a metal surface.
5. also in FIG. 1 area of the drawings the main socket holder body 1 could also be made to be a multiple Multiple "PUSH BUTTON RELEASE MULTIPLE SOCKET HOLDER" with many main socket holder body's 1 built into one main unit.
6. also in FIG. 1 area of the drawings the individual socket holder mountings 20 could be of different drive sizes on the same main socket holder body 1 to accommodate different size drive sockets as needed.
7. also in FIG. 1 area of the drawings the main socket holder body 1 could have on one side of the individual socket holder mountings 20 SAE sizes with a number place also on it and on the other side of the individual socket holder mountings 20 METRIC sizes markings with a numbered place also for the places sockets of a set go and when not in set order number order for the user as needed numbered in numerical order for users who just prefer a numbered space to a socket size space to have SAE metric and numerical numbers on the sides of the individual socket holder mountings 20.
8. also in FIG. 1 area of the drawings individual socket holder mountings 20 could have their own push button release mechanisms but the preferred embodiment is the way the drawings in this application have described, being more efficient and also less parts but just mentioned it could be possible to have individual release mechanism's similar but smaller than the preferred embodiment as shown and described in this disclosure.
9. an additional safety lock for preventing accidental release of sockets could be mounted into as shown in main socket holder body FIG. 1 1 body which would engage control lock notch FIG. 2. 14 this would be a safety lock pin that would be pushed from one side of the main socket holder body FIG. 1 1 thru to intersect with the cut out control lock notch FIG. 2. 14 on the main release control rod 4 this would create a locking action of the up and down movement of the push button 3 which is also the end of main release control rod 4.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a socket holder for a multiple of sockets which has a built into it socket holding locking mechanism, which holds and releases multiples of sockets being held onto it with the push of a button that controls locking mechanisms to hold and release sockets from the main socket holders body when desired by the user.

The push button release multiple socket holder being described here in detail has as shown in FIG. 1 a main body 1, and any number of desired individual socket holder space positions 20 placed along its main body 1 it has a recessed push button opening 18.

Referring to FIG. 4 as shown it has a push button 3 protruding thru the main socket holder body 1.

Figure 6:
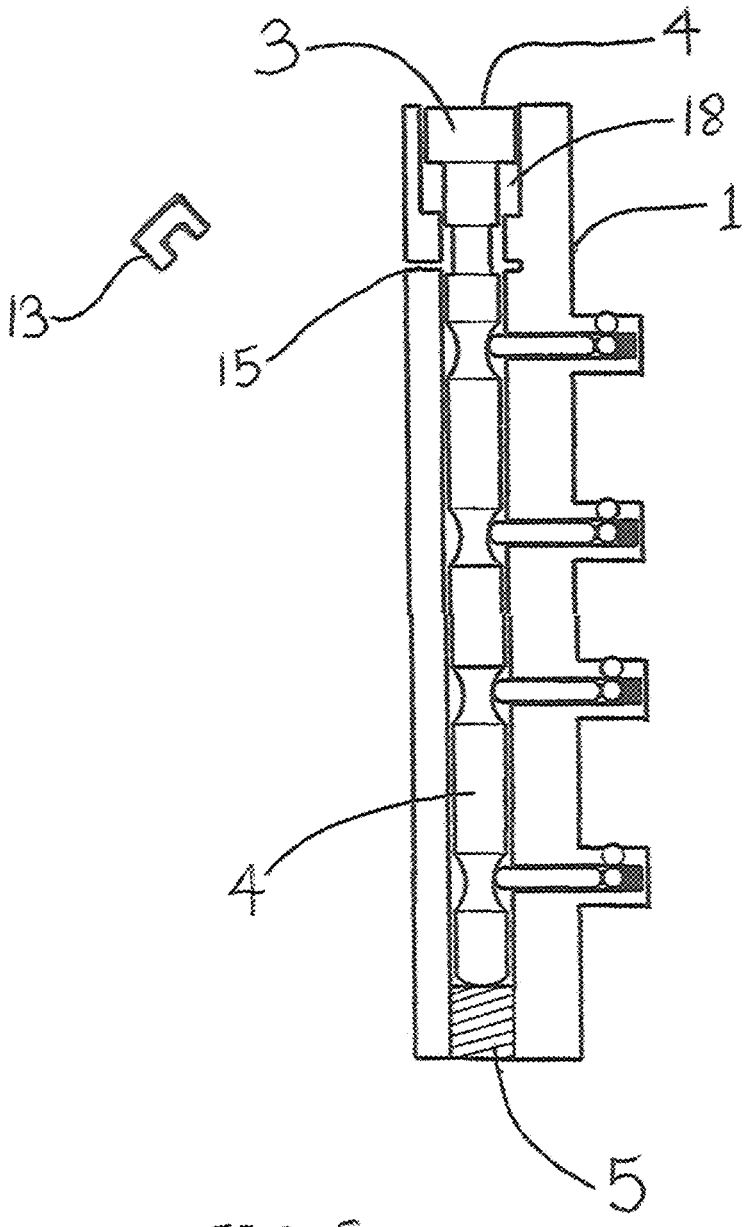
FIG. 6 Is an isometric cross sectional view of the push button release multiple socket holders body, this shows where the control rod locking key goes in the main body control rod lock key notch, along with other internal working intersecting parts.

Referring to FIG. 6 as shown the push button 3 is made on the end of the main release control rod 4 which goes thru the main socket holders body 1, where the bottom end of the main release control rod 4 contacts the main spring 5 is placed in the main body 1.

Referring to FIG. 3 main spring holder position 6, which pushes the main release control rod 4 back up.

Referring to FIG. 2 push button 3 has been pushed down into the recessed push button opening 18 where the control rod lock key 13 is placed into the main body 1 in the main body control rod lock key notch 15.

Figure 7:
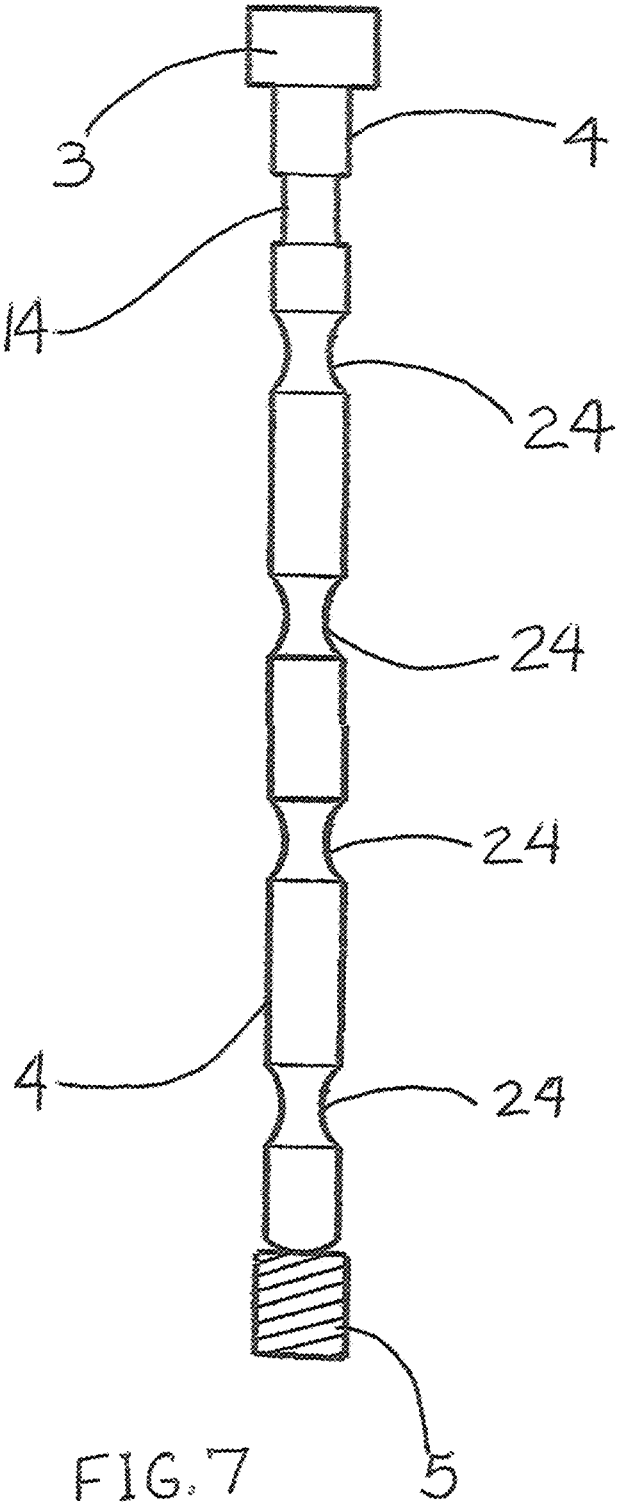
FIG. 7 Is a parallel view of the push button release multiple socket holders body part called the main release control rod and the main spring, it shows the push button top of the main release control rod, the control rod lock notch, and the main release main release control rod intersect notches along with the main spring.
Figure 8:
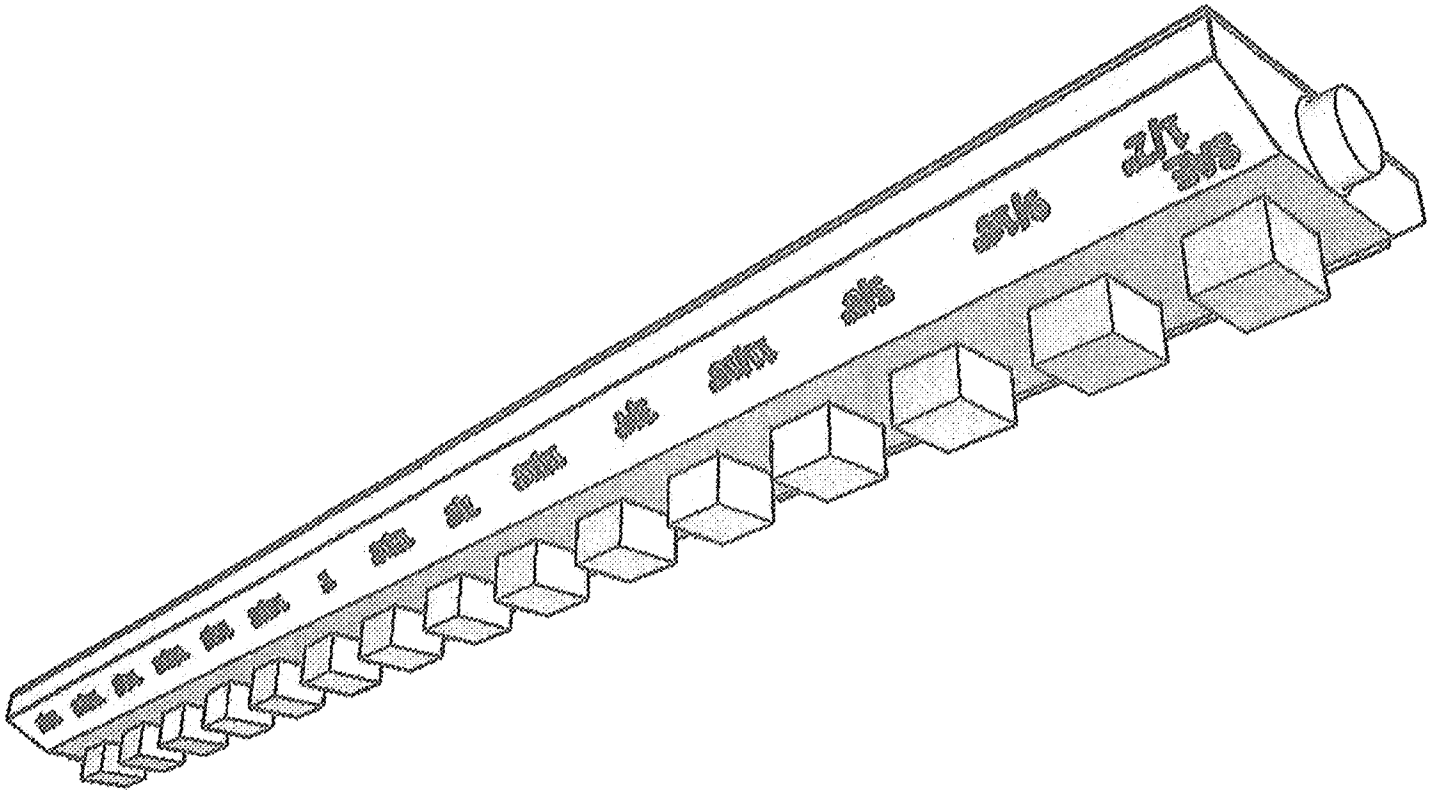
FIG. 8 Is an isometric view of the right side of the "PUSH BUTTON RELEASE MULTIPLE SOCKET HOLDER" with the push button protruding out of the main socket holder body in an enlarged way for viewing purposes in the drawing. Also the SAE size markings on it also.
Figure 9:
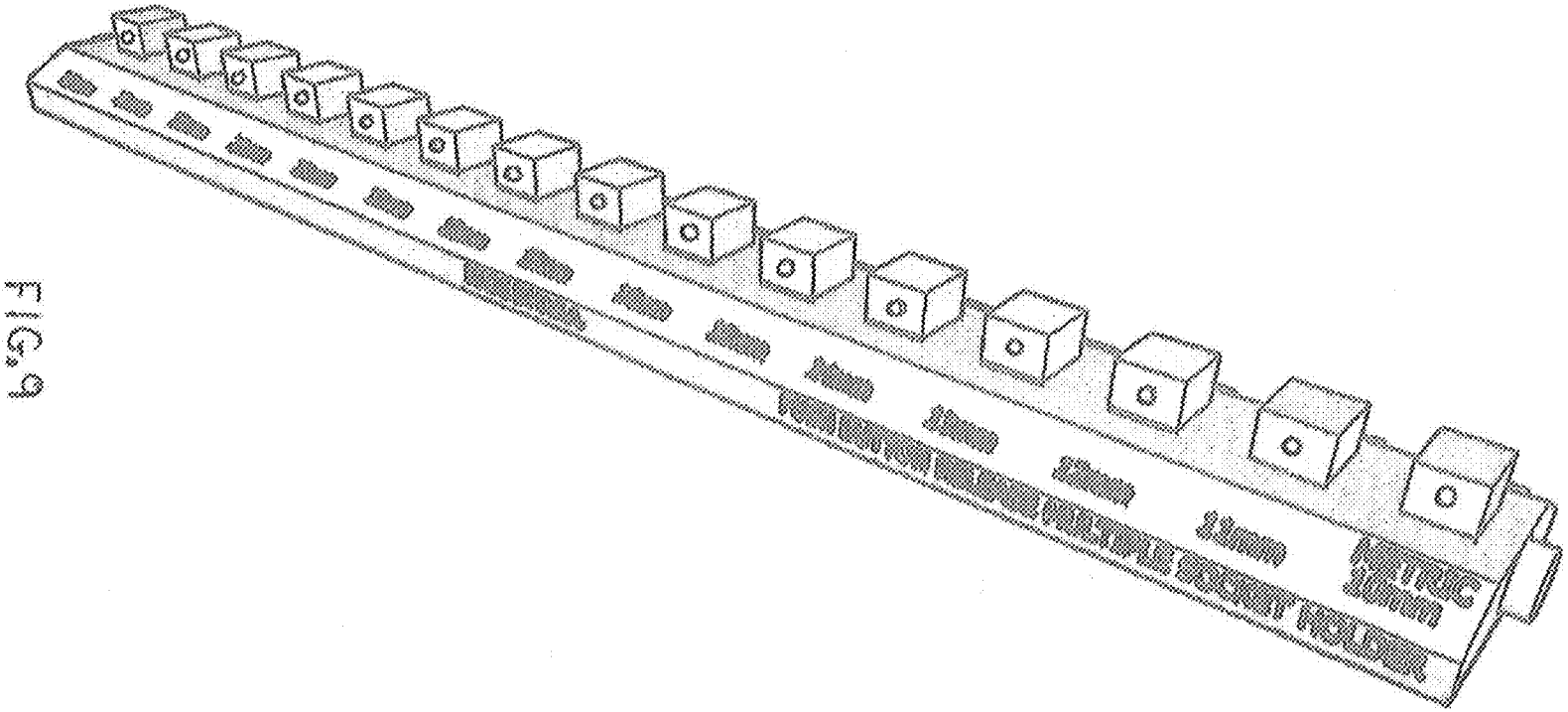
FIG. 9 Is an isometric view of the left side of the "PUSH BUTTON RELEASE MULTIPLE SOCKET HOLDER" with the push button protruding out of the main socket holder body in an enlarged way for viewing purposes in the drawing see it. Also the METRIC size markings on it also.

Referring to FIG. 7 main release control rod lock notch 14 which holds the main release control 4 in place.

Referring to FIG. 6 main socket holder body 1 as the main release control rod 4 goes up and down.

Referring to FIG. 2 and FIG. 3 main push rod slot 2 where the main release control rod 4 intersect with the push rods 10 at the main release control rod 4 main release control rod intersect notches 24 which then pushes push rods 10 against internal locking balls 9 which presses against individual socket holders push springs 11 which are all placed in the guide holes for push rods 16 which allows for the socket locking balls 7 to go in or out in the socket locking ball holes 8 where the socket locking ball holes 8 have all been crimp pressed after the socket locking balls 7 were placed in them upon making of the device to hold the socket locking balls 7 from coming out of their socket locking ball holes 8 in the individual socket holder mountings 20. When push button 3 is released from being pressed down the main spring 5 pushes the main release control rod 4 back up.

Referring to FIG. 6 control rod lock key 13 which stops the upward movement of the main release control rod 4 in the proper place to align all of the internal parts to go back into the socket holding lock positions as this happens.

Referring to FIG. 2 and FIG. 3 the push rods 10 internal locking balls 9 and socket locking balls 7 all go back into the socket holding lock positions because the individual socket holder push springs 11 push these parts back into their original socket holding locked positions as these guide holes for the push rods 16 which allows for the internal locking balls 9 on the individual socket holder mountings 20 lift the socket locking balls 7 back up to the out and locking positions.

Referring to FIG. 2. and FIG. 3. when the main release control rod 4 is pushed down by use of its top end push button 3 the internal push rods 10 in the guide holes for push rods 16 press against and move the internal locking balls 9 against the individual socket holder push springs 11 which allows the socket locking balls 7 to go into the individual socket holder mounting 20 socket locking ball holes 8 which allows sockets to be placed on or off of the individual socket holder mounting 20, and when the push button 3 is released from being pushed down the push rods 16 and the internal locking balls 9 and the socket locking balls 7 the socket holder push springs 11 all go back to their original positions by the force of the socket holder push springs 11 and the main spring 5 placed at the bottom end of the main push rod slot 2 which is located in the main spring holders position 6.

Referring to FIG. 4 when all of the internal parts are assembled and in place the backing plate 12 is put on the back of the main body 1 making the only external moving parts the push button 3. The backing plate 12 can be a magnetic plate and made from hard filled resin.

Referring to FIG. 2 and FIG. 3 socket holding socket locking balls 7.

Figure 10:
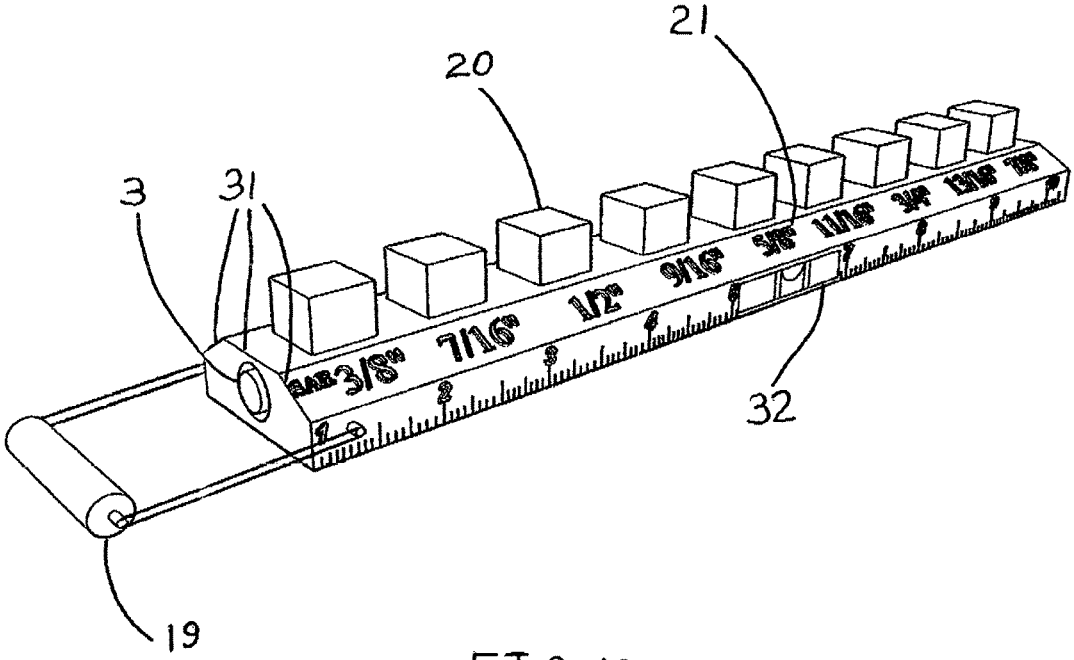
FIG. 10 is an Isometric view of another embodiment of the "PUSH BUTTON RELEAS MULTIPLE SOCKET HOLDER."
Figure 11:
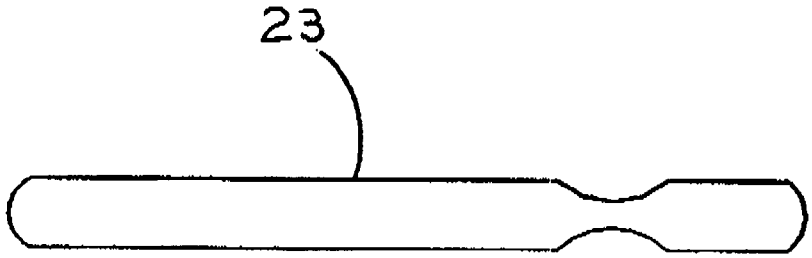
FIG. 11 is an isometric view of a modified push rod for the "PUSH BUTTON RELEAS MULTIPLE SOCKET HOLDER."
Figure 12:
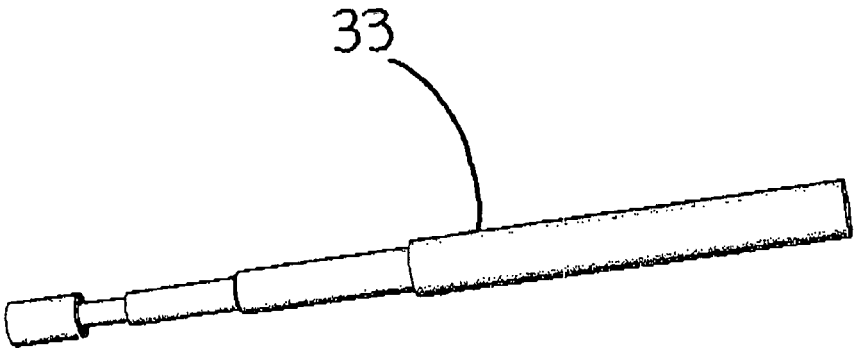
FIG. 12. is an isometric view of another embodiment of the "PUSH BUTTON RELEAS MULTIPLE SOCKET HOLDER" including a telescoping magnetic pickup tool.
Figure 13:
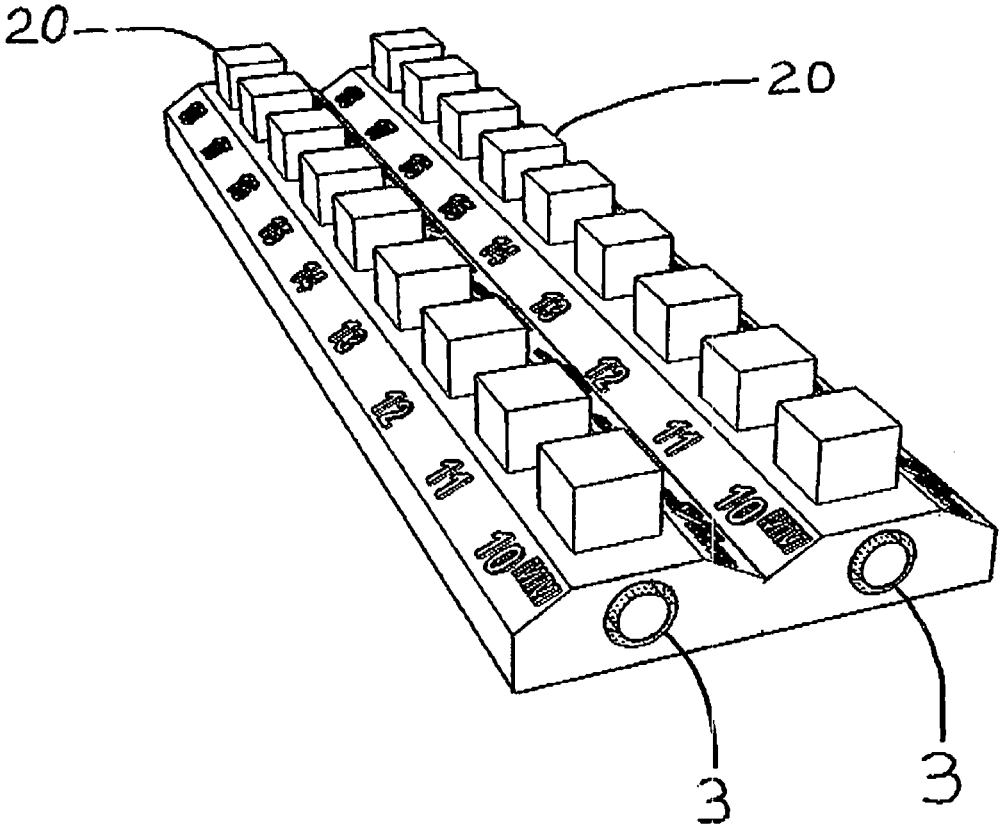
FIG. 13. is an isometric view of another embodiment of the "PUSH BUTTON RELEAS MULTIPLE SOCKET HOLDER" including multiple push buttons and rows of individual socket holder mountings.

FIG. 10 shows an embodiment including a bubble level (32) along with angled surfaces (31) on the main body (1). FIG. 11 shoes a modified push rod (23). FIG. 12 shows a magnetic pickup tool (33). FIG. 13 shows an embodiment including said main socket holder body (1) having at least one additional main release control rod (4) controlling a plurality of additional push rods (10 or 23) and a plurality of additional socket holder mountings (20).

The invention claimed is:

1. Apparatus for holding and releasing tools having a socket drive connection fitting, the apparatus comprising: a main socket holder body (1) having a plurality of socket holder mountings (20), each socket holder mounting (20) having a socket locking ball (7) in a socket locking ball hole (8) which has a crimp to hold the socket locking ball (7) in the respective locking ball hole (8), a guide hole for push rods (16) including a push rod (10) that contacts an internal locking ball (9) that contacts an individual socket holder push spring (11) in the respective socket holder mounting (20), having the crimp on locking ball hole (8) will set a motion limit of the socket locking ball (7) outward movement while preventing it from falling out of the socket locking ball hole (8) while still allowing for movement motion inside of the socket locking ball hole (8) where the socket locking ball (7) can and does meet with to interact internally with the internal locking ball (9) which is located in the guide hole for push rods (16), the guide hole for push rods (16) housing the push rod (10) such that the push rod (10) pushes the internal locking ball (9) against the individual socket holder push spring (11) which then compresses creating a space for movement of the internal locking ball (9), allowing the socket locking ball (7) to go partially into the guide hole for push rods (16) and creating hold or release action on the individual socket holder mountings (20) when the push rod (10) that is located in the guide hole for push rods (16) meets a main release control rod (4) located in the main socket holders body (1) in a main control rod slot (2), where the main release control rod (4) has its range of motion set and determined by a control rod lock key (13) that is placed in a main body control rod lock key notch (15) where it can then intersect with the main release control rod (4) in a cutout section in the form of a control rod lock notch (14), where the control rod lock key (13) is securely held in the main body control rod lock key notch (15) by a backing plate (12), the main release control rod (4) has as one of its ends to be a basic push button end and another end of the main release control rod (4) is resting against a main spring (5) located in a main spring holder position (6) inside of the main socket holder body (1) where it serves the purpose of pushing the main release control rod (4) back up into an original position after the basic push button end has been pressed downward into the main socket holder body (1) where the basic push button end has space to move downward which allows the main release control rod (4) when pressed downward to intersect with the push rods (10), such that main release control rod intersect notches (24) of the main release control rod (4) intersect with and move the push rods (10) which are inside the respective guide holes for push rods (16) against the respective internal locking balls (9) pushing it into and against the respective individual socket holder push springs (11) which then compresses allowing for movement of the respective internal locking balls (9) which allows for movement of the respective socket locking balls (7) in the respective socket locking ball holes (8) to go partially into the guide holes for push rods (16) and then when the basic push button end is released the main spring (5) located in the main spring holder position (6) along with the individual socket holder push springs (11) work together pushing the respective internal locking balls (9) and the respective push rods (10) back into original positions while also moving the respective socket locking balls (7) back into an original socket holding position on each of the individual socket holder mountings (20) while the main release control rod (4) which has as one of its ends as the basic push button end having been released also goes back into an original position releasing force against all the push rods (10).

2. Apparatus for holding and releasing tools having a socket drive connection fitting, the apparatus comprising: a main socket holder body (1) having a plurality of socket holder mountings (20), each socket holder mounting (20) having a socket locking ball (7) in a socket locking ball hole (8) which has a crimp to hold the socket locking ball (7) in the respective locking ball hole (8), a guide hole (16) for modified push rods (16) including a modified push rod (23) that contacts an individual socket holder push spring (11) in the respective socket holder mounting (20), having the crimp on locking ball hole (8) will set a motion limit of the socket locking ball (7) outward movement while preventing it from falling out of the socket locking ball hole (8) while still allowing for movement motion inside of the socket locking ball hole (8) where the socket locking ball (7) can and does meet with to interact internally with the modified push rods (23), the guide hole for modified push rods (23) housing the modified push rod (23) such that the modified push rod (23) pushes against the individual socket holder push spring (11) which then compresses allowing the socket locking ball (7) to go partially into the guide hole for modified push rods (16) and creating hold or release action on the individual socket holder mountings (20) when the modified push rod (23) that is located in the guide hole for push rods (16) meets a main release control rod (4) located in the main socket holders body (1) in a main control rod slot (2), where the main release control rod (4) has its range of motion set and determined by a control rod lock key (13) that is placed in a main body control rod lock key notch (15) where it can then intersect with the main release control rod (4) in a cutout section in the form of a control rod lock notch (14), where the control rod lock key (13) is securely held in the main body control rod lock key notch (15) by a backing plate (12), the main release control rod (4) has as one of its ends to be a basic push button end and another end of the main release control rod (4) is resting against a main spring (5) located in a main spring holder position (6) inside of the main socket holder body (1) where it serves the purpose of pushing the main release control rod (4) back up into an original position after the basic push button end has been pressed downward into the main socket holder body (1) where the basic push button end has space to move downward which allows the main release control rod (4) when pressed downward to intersect with the modified push rods (23), such that main release control rod intersect notches (24) of the main release control rod (4) intersect with and move the modified push rods (23) which are inside the respective guide holes for modified push rods (16) for pushing it against the respective individual socket holder push springs (11) which then compresses allowing for movement of the respective socket locking balls (7) in the respective socket locking ball holes (8) to go partially into the guide holes for push rods (16) and then when the basic push button end is released the main spring (5) located in the main spring holder position (6) along with the individual socket holder push springs (11) work together pushing the respective modified push rods (23) back into original positions while also moving the respective socket locking balls (7) back into an original socket holding position on each of the individual socket holder mountings (20) while the main release control rod (4) which has as one of its ends as the basic push button end having been released also goes back into an original position releasing force against all the modified push rods (23).

3. The apparatus of claim 1 or 2, wherein said main socket holder body (1) has the push button end going into a recessed push button opening (18) on main socket holder body (1).

4. The apparatus of claim 1, wherein said main socket holder body (1) has a plurality of angled surfaces (31).

5. The apparatus of claim 2, wherein said main socket holder body (1) has a plurality of angled surfaces (31).

6. The apparatus of claim 4 or 5, wherein said angled surfaces (31) on said main socket holder body (1) have SAE markings.

7. The apparatus of claim 4 or 5, wherein said angled surfaces (31) on said main socket holder body (1) have ruler markings having metric markings.

8. The apparatus of claim 1 or 2, wherein said main socket holder body (1) has a handle (19).

9. The apparatus of claim 1 or 2, wherein said main socket holder body (1) has a backing plate magnet.

10. The apparatus of claim 1 or 2, wherein said main socket holder body (1) has a backing plate and resin filling.

11. The apparatus of claim 1 or 2, wherein said main socket holder body (1) has a bubble level (32).

12. The apparatus of claim 1 or 2, wherein said main socket holder body (1) has a telescoping magnetic pickup tool (33).

13. The apparatus of claim 1 or 2, wherein said main socket holder body (1) has at least one additional main release control rod (4) controlling a plurality of additional push rods (10 or 13) and a plurality of additional socket holder mountings (20).

* * * * *